US006528745B1

(12) United States Patent
Lathrop et al.

(10) Patent No.: US 6,528,745 B1
(45) Date of Patent: Mar. 4, 2003

(54) MANUAL OPERATOR FOR INTERLOCK

(75) Inventors: Todd Lathrop, Freedom, PA (US); Ronald D. Hartzel, Butler, PA (US); Daniel Kroushl, Wexford, PA (US); Nathan Weister, Beaver Falls, PA (US); Scott A. Martin, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/010,718

(22) Filed: Nov. 13, 2001

(51) Int. Cl.[7] ..... H01H 9/20

(52) U.S. Cl. ..... 200/50.32; 200/322; 200/329; 200/330

(58) Field of Search ..... 200/17 R, 50.32, 200/50.33–50.35, 318, 321, 322, 329–331, 334, 337; 307/64

(56) References Cited

U.S. PATENT DOCUMENTS 4,398,097 A * 8/1983 Schell et al. ..... 307/64
4,760,278 A * 7/1988 Thomson ..... 200/18
4,924,041 A * 5/1990 Yee ..... 200/50.33
5,008,499 A * 4/1991 Yee et al. ..... 200/50.33
5,034,584 A * 7/1991 Fanta et al. ..... 200/17 R
5,081,367 A 1/1992 Smith et al. ..... 307/64
5,254,814 A * 10/1993 Harr ..... 200/17 R
5,397,868 A 3/1995 Smith et al. ..... 200/18
5,422,453 A 6/1995 Smith et al. ..... 200/329
5,436,415 A 7/1995 Smith et al. ..... 200/50 C
5,700,985 A 12/1997 Fischer et al. ..... 200/50.01

* cited by examiner

*Primary Examiner*—Michael Friedhofer
(74) *Attorney, Agent, or Firm*—Martin J. Moran

(57) ABSTRACT

A manual operator assembly is provided for an interlock assembly. The interlock assembly includes a motor assembly that is locked in one of two positions by a brake assembly. The brake assembly is electronically controlled, but also includes a brake release pedal. The manual operator assembly includes a lever which is coupled to a shaft which is further coupled to a cam. When the lever is rotated, the cam engages the brake release pedal so that the interlock assembly may be operated manually.

12 Claims, 3 Drawing Sheets

MANUAL OPERATOR FOR INTERLOCK

BACKGROUND OF THE INVENTION

1. Field of the Invention

This invention relates to devices which interlock circuit breakers to preclude two circuits from being closed simultaneously. Specifically, this invention relates to a manual operator for an electronically controlled interlock assembly.

2. Background Information

There are a number of applications where it is required that the operation of two circuit breakers on a panel board be coordinated such that only one circuit breaker can be in the closed, operating position at one time. One such application is providing a power-consuming load with electrical power from either of two different sources, such as a commercial power system and an auxiliary supply. It is imperative in such applications that only one circuit breaker be in the closed, operating position at one time.

One common circuit breaker configuration has a rectangular body and a pivoting, actuating handle mounted medially thereon. The actuating handle travels in a direction parallel to the longer sides of the rectangular circuit breaker body. Circuit breakers are typically mounted with the switches operating in the vertical direction, typically with the upward position being the closed, operating position.

U.S. Pat. No. 5,081,367 discloses an interlock for circuit breakers coupled to a primary and an auxiliary power source. It is known to have a first and second circuit breaker, each with a pivoting handle, mounted in a spaced relation on a panel. The circuit breakers are structured so that when the handle is in a first position, the circuit breaker is open and when the handle is in a second position, the circuit breaker is closed. Additionally, when the handle of a circuit breaker is in a medial position, the circuit breaker is open. The first circuit breaker may be coupled to the primary power source. The second circuit breaker may be coupled to the auxiliary power source.

A rocking bar interlock assembly is mounted on a support above the circuit breakers. The rocking bar assembly includes a mounting plate, a pivot mounted thereon, and a rocking bar. The rocking bar is coupled to each circuit breaker handle and to the pivot. The pivot is disposed between the spaced circuit breakers. A first, distal end of the rocking bar is coupled to the second circuit breaker handle. The second, proximal end of the rocking bar extends beyond the first circuit breaker and is coupled to a motor. The rocking bar is structured to rotate the rocking bar in a seesaw fashion about the pivot. That is, the motor has a rotary output shaft. A rigid member, having a distal end, extends from, and is perpendicular to, the shaft. A pin is located on the rigid member distal end. The pin extends in a direction generally parallel to the axis of the shaft. The pin is coupled to the rocking arm. The motor is structured to move between a first and second position which are disposed, generally, 180 degrees apart. For description purposes only, the first position shall be described as the 12:00 o'clock position and the second position shall be described as the 6:00 o'clock position. The motor rotates the shaft in a clockwise direction. When the pin is in the 9:00 o'clock position, the pivot, the pin and the shaft lie generally along a single line.

In operation, when the motor is in the first, 12:00 o'clock position, the first circuit breaker is in a closed position and the second circuit breaker is in an open position. As the motor rotates to the 9:00 o'clock position and the rocking arm rotates about the pivot, both circuit breakers are moved into the medial, open position. As the motor further rotates into the second, 6:00 o'clock position, the first circuit breaker is moved into the second, open position and the second circuit breaker is moved into the first, closed position. This procedure is reversed when the motor moves between the 6:00 o'clock position and the 12:00 o'clock position.

The motor for this type of interlock includes an electronic brake device. The brake device is structured to lock the motor in either the 12:00 o'clock or the 6:00 o'clock position. When power is applied to the brake device, the brake is released and the motor may rotate. The disadvantage to this interlock is that, when the electronic control of the brake device becomes inhibited, the motor cannot be rotated. Thus, to switch between the primary and auxiliary power source, the interlock device must be removed.

There is, therefore, a need for a manual control for an electronically operated interlock device.

There is a further need for a manual control that can be operated with one hand so that the other hand may move the interlock rocking bar.

There is a further need for a manual control that is compatible with existing technology.

SUMMARY OF THE INVENTION

These needs, and others, are satisfied by the invention which is directed to a manual operator assembly for a motor driven interlock. The interlock assembly includes a rocking arm that is coupled to a motor. The motor includes a brake assembly that prevents the motor from rotating. The brake assembly may be controlled electronically. The brake assembly also includes brake release pedal that is external to the motor. The manual operator assembly actuates the brake release pedal so that the motor is unlocked and the rocking arm may be moved manually.

The manual operator assembly includes a brake release lever, a shaft, a spring return, and a cam. The interlock rocking bar is mounted on a support plate. The circuit breakers and motor are disposed below the support plate. The manual operator lever is disposed above the support plate. The manual operator shaft extends through the support plate and is coupled to the cam. The cam is positioned adjacent to the brake release pedal. The spring return biases the cam away from the brake release pedal. The manual operator assembly also includes a knob coupled to the rocking arm.

In operation, the motor will be locked in one position by the brake assembly. Typically, the brake assembly is released via an electronic signal. However, if the electronic controls are not operational, a user may operate the interlock using the manual operator. The user rotates, and holds, the brake release lever causing the cam to actuate the brake release pedal. With the brake release pedal actuated, the motor assembly is no longer locked. The user then grasps the knob on the rocking arm and moves it between the first and second positions. Once the rocking arm is in the final position, the user releases the brake release lever, which is then moved out of contact with the brake release pedal by the return spring. Once the brake release pedal is free, the brake assembly re-engages and the motor is locked again.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
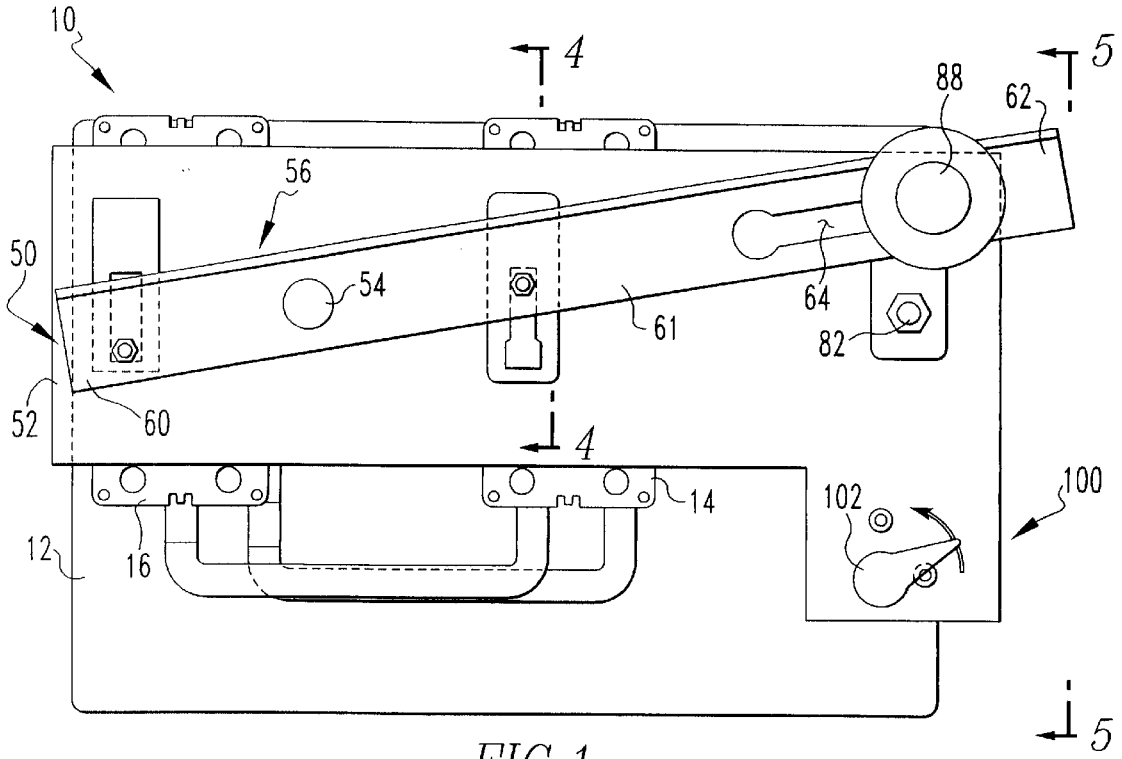
FIG. 1 is a plan view of the interlock assembly in a first position.
Figure 3:
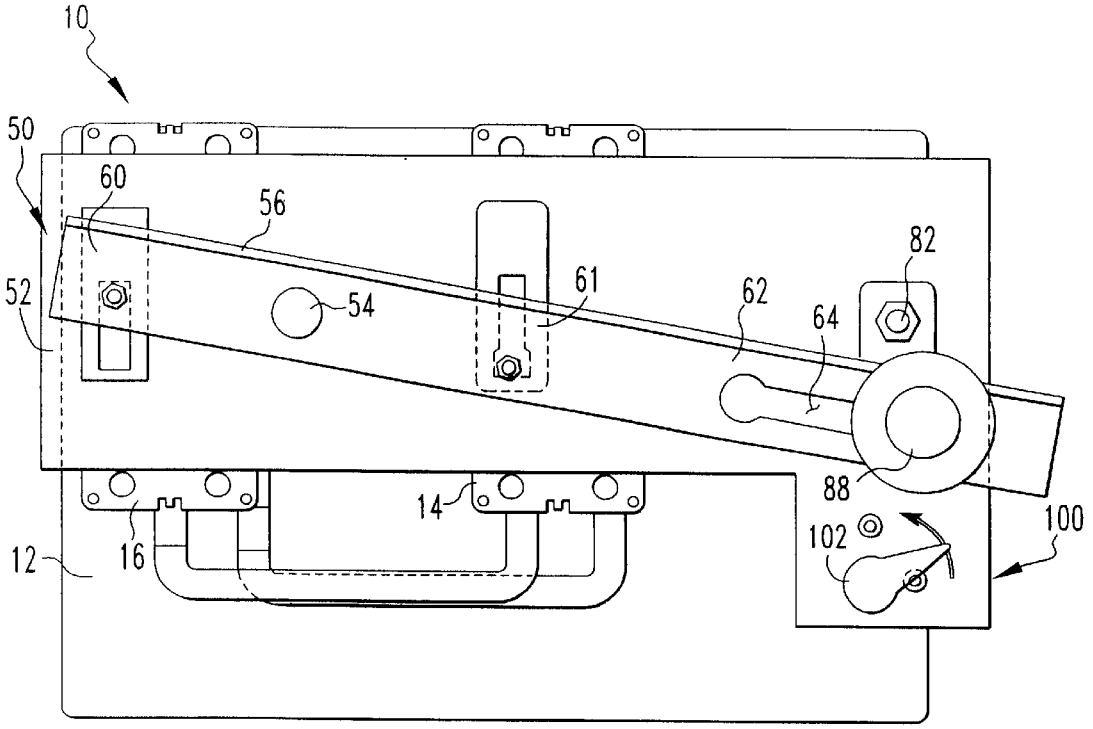
FIG. 3 is a plan view of the interlock assembly in a second position.
Figure 2:
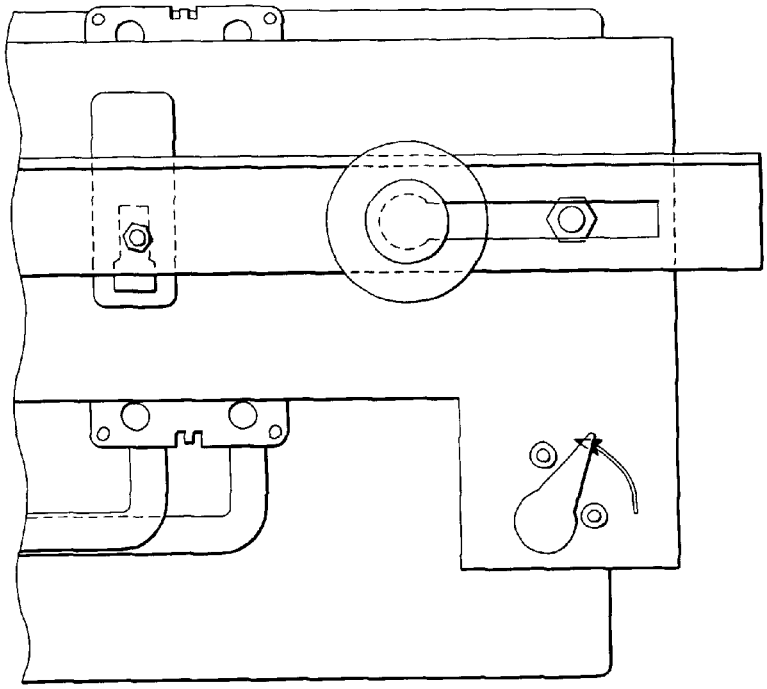
FIG. 2 is a plan view of the interlock assembly in an intermediate position.
Figure 4:
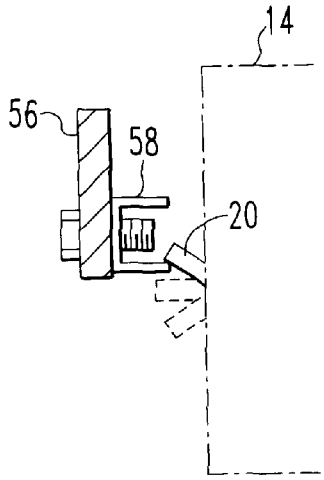
FIG. 4 is a cross-sectional view along line 4—4 on FIG. 1.

Referring to FIGS. 1–3, there is shown a panel board 10 and a rocking bar circuit breaker interlock assembly 50. The panel board 10 includes a mounting plate 12, a first circuit breaker 14 and second circuit breaker 16 mounted in a spaced relation on the panel board 10. As shown on FIG. 4, each circuit breaker 14, 16 includes a handle 20. The handle 20 is structured to pivot through an arc. As is known in the art, within each circuit breaker 14, 16 are a pair of main contacts (not shown). The contacts may be closed, allowing electricity to flow through the circuit breaker 14, 16, or the contacts may be open, preventing electricity from flowing through the circuit breaker 14, 16. The pivoting handle 20 is structured to move between a first position (shown in ghost), wherein the circuit breaker 14, 16 is open, and a second position, wherein the circuit breaker 14, 16 is closed. Additionally, when the handle 20 of a circuit breaker is in a medial position (also shown in ghost), the circuit breaker 14, 16 is open. As shown on FIGS. 1–3, the second, closed position for each circuit breaker handle 20 occurs when the handle 20 is adjacent to the top of the panel board 10, while the first, open position occurs when the handle is adjacent to the bottom of the panel board. The first circuit breaker 14 may be coupled to a commercial power system. The second circuit breaker 16 may be coupled to an auxiliary power source.

A rocking bar interlock assembly 50 is mounted on a support 52 above the panel board 12. The rocking bar interlock assembly 50 includes the support 52, a pivot mounted thereon 54, and a rocking bar 56. As shown on FIG. 4, the rocking bar 56 is coupled to each circuit breaker handle 20 by a clevis 58 located between the rocking bar 56 and the support 52. The pivot 54 is disposed between the spaced circuit breakers 14, 16. The rocking bar 56 is rotatably coupled to the pivot 54. A first, distal end 60 of the rocking bar 56 is coupled to the second circuit breaker 16 handle. A medial portion 61 of the rocking bar 56 is coupled to the first circuit breaker 14 handle. A second, proximal end 62 of the rocking bar 56 extends beyond the first circuit breaker 14. The second, proximal end also includes a slot 64 and is coupled to a motor assembly 80 (described below). The rocking bar 56 is structured to rotate on the pivot 54 in a see-saw fashion.

Figure 5:
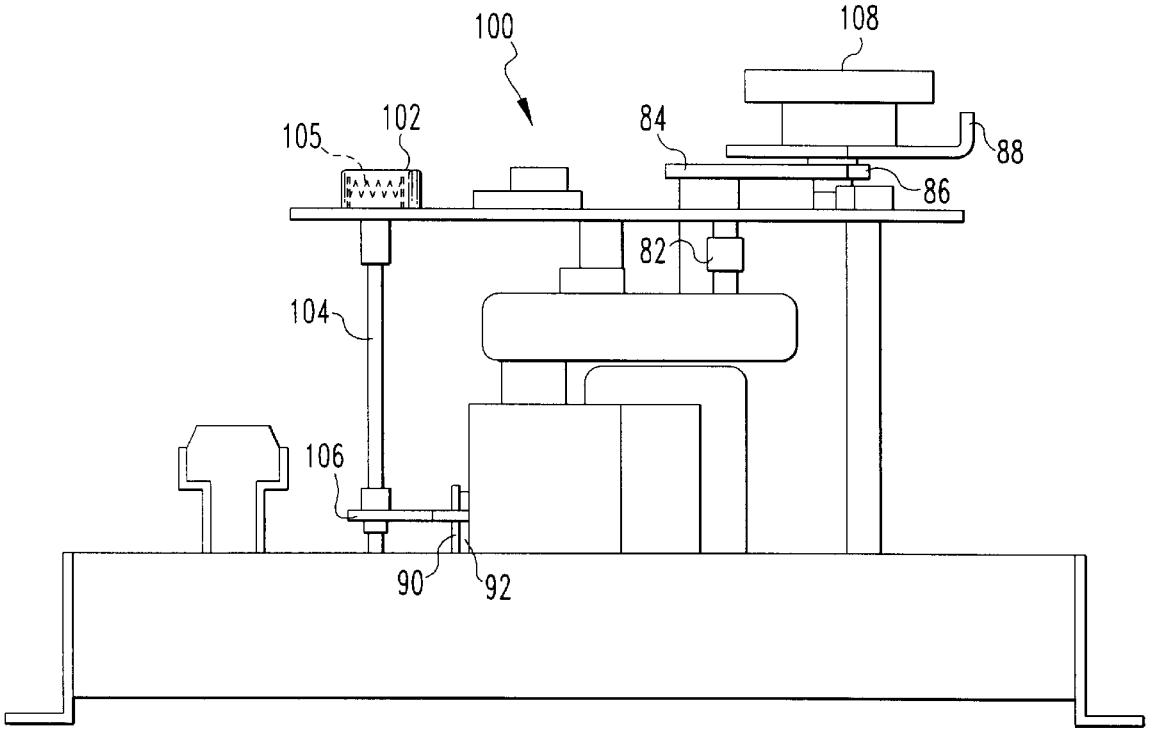
FIG. 5 is a side view of the motor and interlock assembly along line 5—5 on FIG. 1.

As shown on FIG. 5, the motor assembly 80 has a rotary output shaft 82. A rigid member 84, having a distal end 86, extends from, and is perpendicular to, the shaft 82. A pin 88 is located on the rigid member distal end 86. The pin 88 extends in a direction generally parallel to the axis of the shaft 82. The pin 88 is coupled to the rocking arm second, proximal end 62 by extending through rocking arm slot 64. The motor assembly 80 is structured to move between a first and second position which are disposed, generally, 180 degrees apart. As shown in FIGS. 1–3 the first position shall be described as the 12:00 o'clock position (FIG. 1) and the second position shall be described as the 6:00 o'clock position (FIG. 3). When moving the rocking bar 56, the motor assembly 80 rotates the shaft 82 clockwise. Additionally, when the pin is in the 9:00 o'clock position (FIG. 2), the pivot 54, the pin 88 and the shaft 86 lie, generally, along a single line.

The interlock assembly 50 operates as follows, when the motor is in the first, 12:00 o'clock position, first circuit breaker 14 is in a closed position and the second circuit breaker 16 is in an open position. As the motor assembly 80 rotates the shaft 82 to the 9:00 o'clock position, the rocking arm 56 rotates about the pivot 54. As this motion occurs, both circuit breakers 14, 16 are moved into the medial, open position. As the motor assembly 80 further rotates the shaft 82 into the second, 6:00 o'clock position, the first circuit breaker 14 is moved into the open position and the second circuit breaker 16 is moved into the closed position. This procedure is reversed when the motor assembly 80 moves the shaft 82 between the 6:00 o'clock position and the 12:00 o'clock position. That is, both circuit breakers 14, 16 are open at one time and only one circuit breaker 14, 16 is closed at one time.

The motor assembly 80 includes an internal, electronic brake assembly 90, such as a model 3724UP-350 motor, manufactured by Merkle-Korff, 1776 Winthrop Drive, DesPlaines Ill., 60018-1980. The brake assembly 90 is structured to lock the motor in either the 12:00 o'clock or the 6:00 o'clock position. When the brake assembly 90 is actuated, the brake assembly 90 unlocks the motor assembly 80 so shaft 82 may rotate. The brake assembly 90 is normally not actuated and the motor assembly 80 is normally locked. The brake assembly 90 includes an external release pedal 92. The external release pedal 92 is a switch that, when actuated, releases the break assembly 90.

As seen best in FIG. 5, the manual operator assembly 100 includes a means for actuating the brake release pedal 92 and a means for manually rotating the rocking arm 56. The means for actuating the brake release pedal 92 includes a lever 102, a shaft 104, a spring return 105 (shown schematically), and a cam 106. The manual operator lever 102 is disposed above the support 12. The lever 102 is coupled to the shaft 104. The shaft 104 extends through, and is rotatably mounted on, the support 12. The shaft 104 is further coupled to the cam 106. The cam 106 is positioned adjacent to the brake release pedal 92. Thus, as the lever 102 is rotated, the shaft 104 and the cam 106 rotate. The return spring 105 is encapsulated by the lever 102. The spring return 105 biases the cam 106 away from the brake release pedal 92. The manual operator assembly 100 also includes a means for manually rotating the rocking arm 56, such as a knob 108, disposed about pin 88 and coupled to the rocking arm 56.

In operation, the motor assembly 80 is locked in one position by the brake assembly 90. Typically, the brake assembly 90 is released via an electronic signal, thus allowing the interlock assembly 50 to switch between the first and second circuit breakers 14, 16. However, if the electronic controls are not operational, a user may operate the interlock assembly 50 using the manual operator assembly 100. The user rotates the manual operator lever 102 causing the cam 106 to actuate the brake release pedal 92. With the brake release pedal 92 actuated, the motor assembly 80 is no longer locked. The user then grasps the knob 108 on the rocking arm 56 and moves it between the 12:00 o'clock and 6:00 o'clock positions. Once the rocking arm 56 is in the final position, the user releases the manual operator lever 102, which is then moved out of contact with the brake release pedal 92 by the return spring 105. Once the brake release pedal 92 is free, the brake assembly re-engages and the motor assembly 80 is again locked.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A manual operator assembly for an interlock assembly, said interlock assembly coupled to a first and second circuit breaker, said first and second circuit breaker each having a pivotable handle, each of said handles pivotable between a first position wherein the circuit breaker is open and a second position wherein the circuit breaker is closed, said interlock assembly having a support, a pivot and a rocking bar, said rocking bar coupled to a motor assembly and to said first and second circuit breakers, said rocking bar structured so that only one of said first or second circuit breakers may be in said closed position at one time, said motor assembly having an output shaft that rotates and is structured to move said rocking bar between a first position and a second position, said motor assembly having a brake assembly that locks said motor assembly in one of two positions, said brake assembly having a brake release pedal structured to release the brake assembly so that said motor assembly shaft may rotate, said manual operator assembly comprising:

a means for manually actuating said brake release pedal; and a means for manually rotating said rocking bar;

whereby, after said means for manually actuating said brake release pedal is actuated, said means for manually rotating said rocking bar is free to rotate said rocking bar.

2. The manual operator assembly of claim 1 wherein said means for manually rotating said rocking bar is a knob coupled to said rocking arm.

3. The manual operator assembly of claim 1 wherein said means for actuating said brake release pedal includes:

a lever;

a shaft coupled to said lever;

a cam coupled to said shaft;

said cam disposed adjacent to said brake release pedal; and said lever, shaft and cam are structured so that, as said lever is rotated, said shaft rotates said cam into said brake release pedal thereby actuating said brake release pedal.

4. The manual operator assembly of claim 3 wherein said means for manually rotating said rocking bar is a knob coupled to said rocking arm.

5. The manual operator assembly of claim 3 wherein said means for actuating said brake release pedal further includes a spring structured to bias said cam out of contact with said brake release pedal.

6. An interlock assembly for a first and second circuit breaker, said first and second circuit breaker each having a pivotable handle, each of said handles pivotable between a first position wherein the circuit breaker is open and a second position wherein the circuit breaker is closed, said interlock assembly comprising:

a support disposed above said first and second circuit breakers;

a pivot disposed on said support at a location between said first and second circuit breakers;

a rocking bar rotatably coupled to said pivot and having a first end, a medial portion, and a second end;

said rocking bar first end coupled to said second circuit breaker;

said rocking bar medial portion coupled to said first circuit breaker;

a motor having rotary output shaft and a brake assembly structured to lock said motor shaft in a position;

said rocking bar second end coupled to said motor;

said brake assembly structured to be electronically actuated to release said motor shaft assembly so said motor shaft may rotate and having a brake release pedal structured to release said brake assembly so said motor shaft may rotate; and a manual operator assembly having a means for actuating said brake release pedal and a means for manually rotating said rocking bar.

7. The manual operator assembly of claim 6 wherein said means for manually rotating said rocking bar is a knob coupled to said rocking arm.

8. The manual operator assembly of claim 6 wherein said means for actuating said brake release pedal includes:

a lever;

a shaft coupled to said lever;

a cam coupled to said shaft;

said cam disposed adjacent to said brake release pedal; and said lever, shaft and cam are structured so that, as said lever is rotated, said shaft rotates said cam into said brake release pedal thereby actuating said brake release pedal.

9. The manual operator assembly of claim 8 wherein said means for manually rotating said rocking bar is a knob coupled to said rocking arm.

10. The manual operator assembly of claim 8 wherein said means for actuating said brake release pedal further includes a spring structured to bias said cam out of contact with said brake release pedal.

11. A method of manually operating an interlock assembly, said interlock assembly coupled to a first and second circuit breaker, said first and second circuit breaker each having a pivotable handle, each of said handles pivotable between a first position wherein the circuit breaker is open and a second position wherein the circuit breaker is closed, said interlock assembly having a support, a pivot and a rocking bar, said rocking bar coupled to a motor assembly and to said first and second circuit breakers, said rocking bar structured so that on one of said first or second circuit breakers may be in said closed position at one time, said motor assembly having an output shaft that rotates and is structured to move said rocking bar between a first position and a second position, said motor assembly having a brake assembly that locks said motor assembly in one of two positions, said brake assembly having a brake release pedal structured to release the brake assembly so that said motor assembly shaft may rotate, said interlock assembly further having a manual operator which includes a lever coupled to a shaft, said shaft rotatably mounted on said support, said shaft further coupled to a cam disposed adjacent to said brake release pedal, and a knob coupled to said rocking bar, said method comprising the steps of:

a) having said rocking bar in a first position wherein said first circuit breaker in a closed position and said second circuit breaker in an open position;

b) having said motor assembly locked by said brake assembly;

c) rotating said lever so that said cam engages said brake release pedal thereby releasing said brake assembly;

d) gripping said knob;

e) using said knob to move said rocking bar from said first position to a second position wherein said first circuit breaker in an open position and said second circuit breaker in a closed position;

f) releasing said lever and said knob.

12. The method of claim 11 wherein steps c-f are performed by a single person.

* * * * *